US008706013B2

(12) United States Patent
Takahashi et al.

(10) Patent No.: US 8,706,013 B2
(45) Date of Patent: Apr. 22, 2014

(54) FIXING DEVICE AND IMAGE FORMING APPARATUS

(75) Inventors: Katsunori Takahashi, Hachioji (JP); Masashi Sugano, Hachioji (JP); Akinori Kimata, Toyokawa (JP); Akifumi Isobe, Hidaka (JP); Kenji Tamaki, Tokorozawa (JP); Satoshi Shimao, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 246 days.

(21) Appl. No.: 13/105,978

(22) Filed: May 12, 2011

(65) Prior Publication Data

US 2011/0280603 A1 Nov. 17, 2011

(30) Foreign Application Priority Data

May 17, 2010 (JP) ..... 2010-112836

(51) Int. Cl.
*G03G 15/20* (2006.01)

(52) U.S. Cl.
USPC ..... 399/323; 399/67; 399/92

(58) Field of Classification Search
USPC ..... 399/45, 67, 92, 320, 322, 323
See application file for complete search history.

(56) References Cited

U.S. PATENT DOCUMENTS

| | | | | |
|---|---|---|---|---|
| 7,593,659 | B2 | 9/2009 | Takayanagi | |
| 2008/0193176 | A1* | 8/2008 | Roof | 399/323 |
| 2009/0226200 | A1* | 9/2009 | Ando | 399/69 |

FOREIGN PATENT DOCUMENTS

| | | |
|---|---|---|
| JP | 2005-201917 | 7/2005 |
| JP | 2005-258035 | 9/2005 |
| JP | 2005-315966 | 11/2005 |
| JP | 2007-086132 | 4/2007 |
| JP | 2007-240962 | 9/2007 |
| JP | 2008-83475 A | 4/2008 |

OTHER PUBLICATIONS

Chinese Office Action in corresponding application No. 201110126537.9 mailed Dec. 4, 2012.
Japanese Notice of Reasons for Rejection Mailed Aug. 13, 2013 in Counterpart Japanese Patent Application No. 2010-112836 (6 pp).

* cited by examiner

*Primary Examiner* — Walter L Lindsay, Jr.
*Assistant Examiner* — Jessica L Eley
(74) *Attorney, Agent, or Firm* — Finnegan, Henderson, Farabow, Garrett & Dunner, L.L.P.

(57) ABSTRACT

In order that the air surrounding a fixing member is prevented from entering a blowing section for blowing separation air, a wind speed setting section is provided with switchable control modes, namely, a first control mode (control mode for operating the blower fan at a wind speed for separation) and a second control mode (control mode for operating the blower fan at a low speed). This structure allows the blower fan to be controlled in conformity to any one of these first and second control modes.

9 Claims, 7 Drawing Sheets

| PAPER TYPE | WIND SPEED |
|---|---|
| A | a |
| B | b |
| C | c |
| D | d |

a > b > c > d

FIG. 4a

| PAPER TYPE | WIND SPEED |
|---|---|
| A | a |
| B | b |
| C | c |
| D | d |

a > b > c > d

FIG. 4b

PRIOR ART

| PAPER TYPE | WIND SPEED |
|---|---|
| A | a |
| B | b |
| C | c |
| D | - |

a > b > c

FIXING DEVICE AND IMAGE FORMING APPARATUS

This application is based on Japanese Patent Application No. 2010-112836 filed on May 17, 2010 with Japanese Patent Office, the entire content of which is hereby incorporated by reference.

BACKGROUND OF THE INVENTION

The present invention relates to a fixing device and an image forming apparatus using the same.

An image forming apparatus using the electrophotographic process has been known as a printer or photocopier. In the image forming apparatus of this type, a sheet is passed through the pressure contact portion (fixing nip portion) of a pair of fixing members constituting a fixing device, and the toner is heated, whereby a toner image is fixed onto the sheet. Since fixing is performed by heat and pressure, the sheet having passed through the fixing nip portion may be ejected with the fixing member being wound with the sheet. Then the sheet may not be separated from the fixing member.

For example, the Unexamined Japanese Patent Application Publication No. 2005-258035 discloses a fixing device and image forming apparatus that are provided with a so-called air separation function where a sheet is separated from the fixing member by air blowing. For example, when sheets are processed on a continuous basis, the temperature on the surface of the fixing roller is raised as compared to the case where only one sheet is processed. This may fail to produce a good image quality. To solve this problem, this fixing device changes the wind speed for separation air in conformity to the temperature of the fixing roller. To put it more specifically, if the temperature of the fixing roller is higher than that in a reference range where the satisfactory image quality can be maintained, the wind speed for separation air is set at a value greater than the reference wind speed. This ensures the temperature on the surface of the fixing roller within the reference range. In the meantime, when the temperature of the fixing roller is lower than the reference range, the wind speed for separation air is set at a level lower than the reference wind speed. This prevents fixing failure from occurring due to the toner temperature failing to increase up to the level required for fixing.

In the fixing device of this type, blowing of separation air by the blowing section is suspended in some cases during the time when there is no need for blowing the separation air. The fixing device is placed under the conditions of high temperature and high humidity due to thermal fixing. Accordingly, the air around the fixing member enters the blowing section, and this may raise the following problem. To put it more specifically, condensation is caused on the blowing section, whereby operation failure or a breakdown of the blowing section may occur. Alternatively, when blowing of separation air has started, condensate is scattered on the fixing member. This may reduce the fixing quality.

The Unexamined Japanese Patent Application Publication No. 2005-258035 discloses the technique of variable control of the wind speed for separation air. However, this wind speed control is intended only to change the wind speed within the range of separating the sheets from one another.

The present invention is intended to solve the aforementioned problems. Thus, one of the objects of the present invention is to prevent the air around a fixing member from entering the blowing section for blowing separation air.

SUMMARY

To achieve at least one of the aforementioned objects, the fixing device and image forming apparatus reflecting one aspect of the present invention includes the following:

The first embodiment of the present invention provides a fixing device including: a fixing section for fixing a toner image on a sheet by passing the sheet through a fixing nip portion and supplying heat to the toner image having been transferred onto the sheet, with the fixing nip portion being formed by pressing a pair of fixing members in contact with each other; a blowing section for separating the sheet from the pair of fixing members by blowing gas to the sheet from a sheet ejection side of the fixing nip portion; and a control section for controlling a wind speed of the gas blown by the blowing section. In this case, the control section includes as switchable control modes: a first control mode for controlling the blowing section at a wind speed for separation which includes one or more set wind speeds having been set for separating the sheet from the pair of fixing members; and a second control mode for controlling the blowing section at a wind speed smaller than a smallest set wind speed of the wind speed for separation. The control section selects the second control mode on a priority basis and controls the blowing section in any one of the first and the second control modes, and determines whether or not the control mode needs to be switched to the first control mode according to a type of the sheet to be subjected to fixing, and when the control mode needs to be switched to the first control mode, the control section switches the control mode from the second control mode to the first control mode so as to control the blowing section.

The second embodiment of the present invention provides an image forming apparatus including: an image forming unit for transferring a toner image onto a sheet; and a fixing unit for applying a fixing process to the sheet with the toner image transferred thereon. The fixing unit has a fixing section for fixing the toner image on the sheet by passing the sheet through a fixing nip portion and supplying heat to the toner image having been transferred onto the sheet, with the fixing nip portion being formed by pressing a pair of fixing members in contact with each other; a blowing section for separating the sheet from the pair of fixing members by blowing gas to the sheet from a sheet ejection side of the fixing nip portion; and a control section for controlling a wind speed of the gas blown by the blowing section. In this case, the control section having, as switchable control modes: a first control mode for controlling the blowing section at a wind speed for separation which includes one or more set wind speeds having been set for separating the sheet from the pair of fixing members; and a second control mode for controlling the blowing section at a wind speed smaller than a smallest set wind speed of the wind speed for separation. The control section selects the second control mode on a priority basis and controls the blowing section in any one of the first and the second control modes, and determines whether or not the control mode needs to be switched to the first control mode according to a type of the sheet to be subjected to fixing, and when the control mode needs to be switched to the first control mode, the control section switches the control mode from the second control mode to the first control mode so as to control the blowing section.

BRIEF DESCRIPTION OF THE DRAWINGS

FIGS. 4*a* and 4*b* are explanatory diagrams showing the relationships between the wind speed of separation air and paper type.

DETAILED DESCRIPTION OF THE PREFERRED EMBODIMENT

The following describes further embodiments based on the aforementioned embodiment.

In the first embodiment of the present invention, the control section preferably controls the blowing section in any one of the first and second control modes during the operation period from startup of the apparatus operation to the termination thereof.

In the first embodiment of the present invention, it is preferred that the pair of fixing members are controlled by the control section in such a way as to permit switching between the state of pressure contact where the pair of fixing members are pressed in contact with each other, and the detached state where these fixing members are detached from each other. In this case, the control section preferably controls the pair of fixing members to be in the state of pressure contact during the operation.

In the first embodiment of the present invention, when the pair of fixing members is to be switched from the state of pressure contact to the detached state during the operation, the control section preferably allows air blowing by the blowing section to be stopped and suspends the second control mode. Here when shifting to the standby mode where the apparatus is waiting for a printing instruction or the low power mode where the power consumption is reduced, the control section preferably determines whether or not the state of the pair of fixing members should be switched from the state of pressure contact to the detached state. Further, when the second control mode is to be suspended, the control section preferably suspends air blowing by the blowing section before switching the pair of fixing members from the state of pressure contact to the detached state.

In the first embodiment of the present invention, when the pair of fixing members having been set to the detached state is to be returned to the state of pressure contact, the control section preferably allows air blowing to be started by the blowing section, and the second control mode to be started again. Here when the second control mode having been suspended is to be restarted, the control section preferably allows air blowing to be started by the blowing section after the pair of fixing members has been switched from the detached state to the state of pressure contact.

Further, in the first embodiment of the present invention, when air blowing by the blowing section is to be suspended, the control section preferably suspends the supply of power to the blowing section.

The following describes specific Examples:

FIRST EXAMPLE

Figure 1:
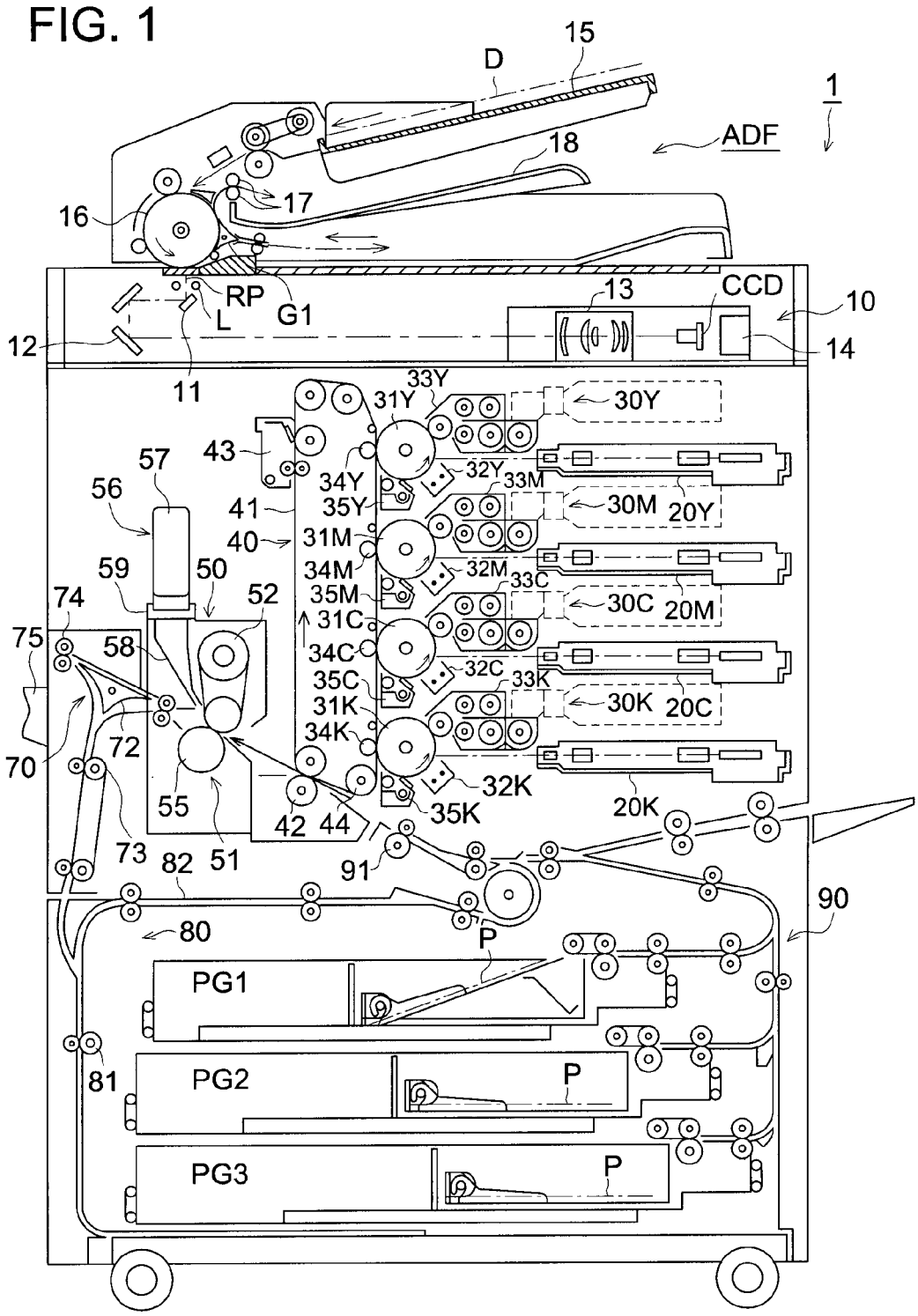
FIG. 1 is an explanatory diagram schematically showing the configuration of an image forming apparatus 1.

FIG. 1 is an explanatory diagram schematically showing the configuration of an image forming apparatus 1 in the present Example. The image forming apparatus 1 is an image forming apparatus using electrophotographic process as exemplified by a photocopier. It is a so-called tandem type color image forming apparatus where a plurality of photoconductors is placed opposed to one intermediate transfer belt and are arranged in the vertical direction, whereby a full-color image is formed.

The major components of this image forming apparatus 1 include a document reading section 10, exposure sections 20Y, 20M, 20C and 20K, image forming sections 30Y, 30M, 30C, 30K, intermediate transfer section 40, fixing device (fixing unit) 50, ejected sheet reversing section 70, sheet re-feed section 80, and sheet feed section 90. These components are accommodated in one housing.

The document reading section 10 is provided with an automatic document feed device ADF on the top thereof. The documents D placed on the document platen 15 of the automatic document feed device ADF are separated from one another and are fed one by one to the document conveying path. These documents are then conveyed by the conveying drum 16. The first conveying guide G1 and document ejection roller 17 eject the document D conveyed by the conveying drum 16, to the document ejection tray 18.

The document reading section 10 reads the image of the document D being conveyed by the conveying drum 16, at the document image reading position RP. To put it more specifically, the image of the document D is irradiated with a lamp L at the document image reading position RP. The reflected light by irradiation is guided by the first minor unit 11, the second minor unit 12 and lens unit 13 and an image is formed on the light receiving surface of the image pickup element CCD. The image pickup element CCD allows the incoming light to be subjected to photoelectric conversion so that a prescribed image signal is outputted. The outputted image signal is subjected to analog-to-digital conversion, whereby input image data is formed. This input image data corresponds to the image as the basis of forming an image. The created input image data is inputted into the image reading control section 14.

Figure 3:
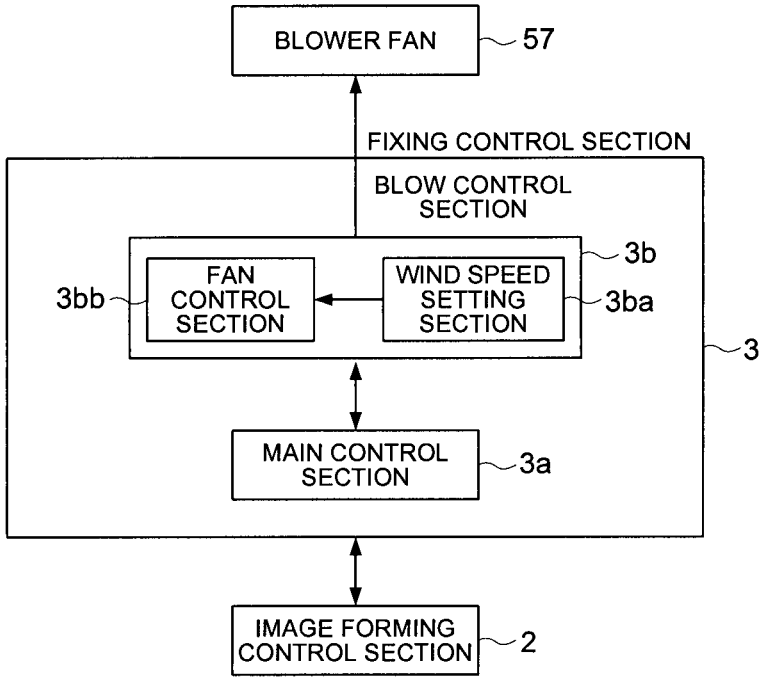
FIG. 3 is a block diagram schematically representing the control system of the image forming apparatus 1.

The image reading control section 14 applies such processing as shading correction, dither processing and compression to the input image data, and stores the data resulting from this processing as output image data into the storage section of the image forming control section 2 (FIG. 3). The output image data can be the data received from a personal computer or other image forming apparatuses linked to the image forming apparatus 1.

The exposure sections 20Y to 20K are configured with laser light sources, polygon mirrors, plural lenses (not illustrated) so as to generate laser beams. The exposure sections 20Y to 20K performs scan exposure on surfaces of the photoconductors 31Y, 31M, 31C and 31K which are components of the image forming sections 30Y to 30K with laser beams in accordance with output information outputted from the image forming control section 2 based on the output image data. Latent images are formed on the photoconductors 31Y to 31K by scanning exposure with the laser beams.

The image forming section 30Y is composed of the photoconductor 31Y and of the main charging section 32Y, developing section 33Y, first transfer roller 34Y and cleaning section 35Y which are arranged on the circumference of the photoconductor 31Y. Other image forming sections 30M, 30C and 30K are the same as the image forming section 30Y in terms of construction, and the main charging sections 32M, 32C and 32K, developing sections 33M, 33C and 33K, first transfer rollers 34M, 34C and 34K and cleaning sections 35M, 35C and 35K are arranged, respectively on the circumferences of the photoconductors 31M, 31C and 31K.

The surface of each of the photoconductors 31Y to 31K is charged uniformly by the main charging sections 32Y to 32K. Each of the developing sections 33Y to 33K develops a latent image on each of the photoconductor 31Y to 31K with toner, whereby the toner image is formed on each of the photoconductor 31Y to 31K.

The first transfer rollers 34Y to 34K transfer toner images formed respectively on the photoconductors 31Y to 31K successively onto a prescribed position on the intermediate transfer belt 41 of the intermediate transfer section 40. The cleaning sections 35Y to 35K remove toners remaining respectively on surfaces of the photoconductors 31Y to 31K on which the transfer of toner images have been finished.

The second transfer roller 42 of the intermediate transfer section 40 transfers a toner image having been transferred onto the intermediate transfer belt 41, onto the sheet P. The sheet P to be subjected to transferring is conveyed from the trays PG1, PG2 and PG3 of the sheet feeding section 90 and has been fed out to the second transfer miler 42 while being synchronized by sheet feeding roller 91. The belt cleaning section 43 cleans the surface of the intermediate transfer belt 41 which has finished transferring of the toner image onto the sheet P, and the cleaned intermediate transfer belt 41 is used for succeeding image transfer.

The sheet P on which a toner image has been transferred, that is, the sheet P carrying unfixed toner image on the surface to be subjected to fixing is sent to the fixing section 50, and the fixing section 50 causes the toner image to be fixed on the surface to be subjected to fixing of the sheet P, by pressing the sheet P with heat. The details of the fixing device 50 will be described later.

The sheet ejection reversing section 70 conveys the sheet P which has finished fixing processing by the fixing section 50, and ejects the sheet P to the sheet ejection tray 75. When ejecting the sheet P by reversing inside out, the sheet ejection guide 72 leads the sheet P downward once. Then, the sheet P is reversed and conveyed after the trailing edge of the sheet P is interposed between the sheet ejection reversing roller 73, and the sheet P is led by the sheet ejection guide 72 to the sheet ejection roller 74 to be ejected.

When an image is formed also on the back surface of the sheet P, the sheet ejection guide 72 leads the sheet P which has finished in terms of fixing processing for the toner image on the front surface to the sheet re-feeding section 80 positioned at a lower part, and the sheet P is fed in the opposite direction to be reversed after the trailing edge of the sheet P is interposed between the sheet re-feeding reversing roller 81, thus, the sheet P is fed out to the sheet re-feeding conveyance path 82 to be ready for image forming on the back surface of the sheet P.

Figure 2:
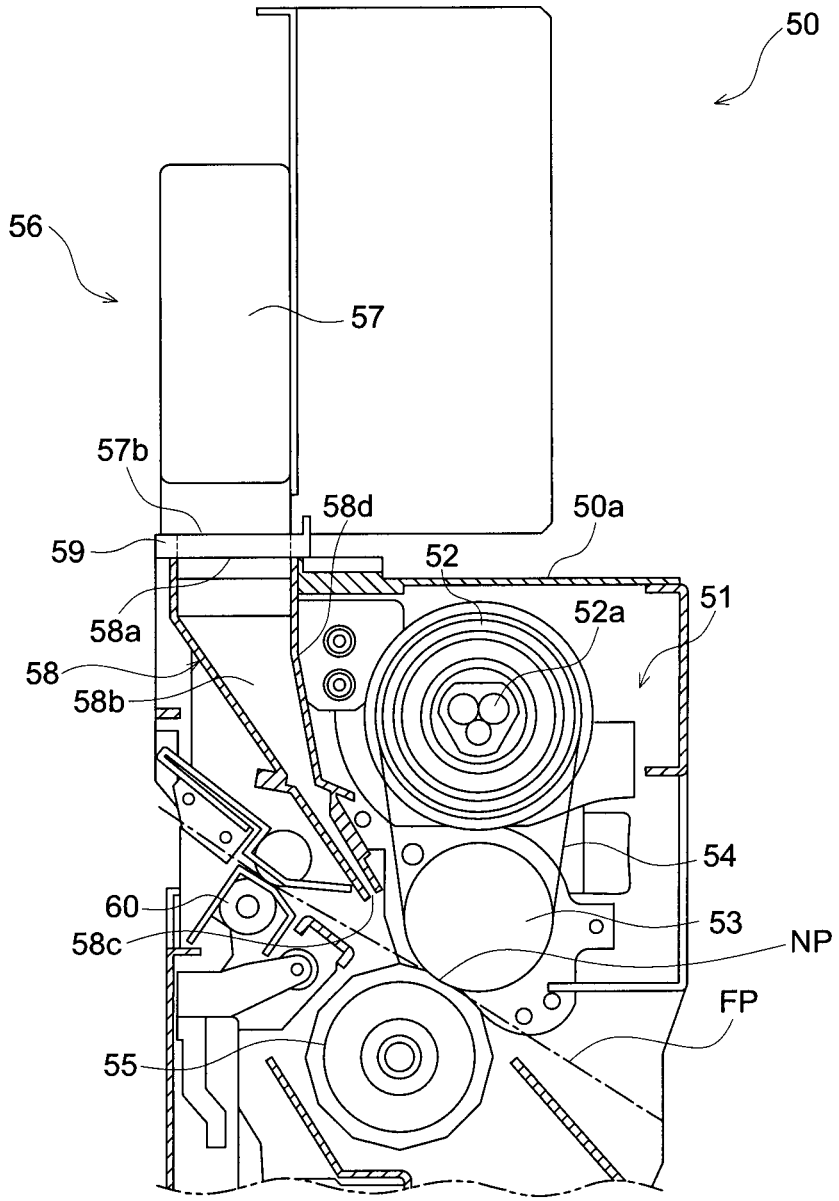
FIG. 2 is a cross sectional view schematically representing a fixing device 50.

FIG. 2 is a cross sectional view schematically representing a fixing device 50. The fixing device 50 includes a fixing section 51 and blowing section 56.

The major components of the fixing section 51 include a heating roller 52, upper fixing roller 53, endless fixing belt 54 and lower fixing roller 55. The heating roller 52 and upper fixing roller 53 are arranged apart from each other by a prescribed distance, and a fixing belt 54 is applied between these rollers 52 and 53. The lower fixing roller 55 is arranged in a state where it is pressed in contact with the fixing belt 54 in the range where the fixing belt 54 is kept in contact with the upper fixing roller 53. Basically, a fixing nip portion NP is formed in the pressure contact portion between the fixing belt 54 and lower fixing roller 55.

The sheet P is conveyed in such a way that the surface to be fixed faces the fixing belt 54. The sheet P passes through the fixing nip portion NP in the process of being conveyed. This arrangement allows the toner image to be fixed onto the surface of the sheet P by the pressure of the fixing belt 54 (upper fixing roller 53) and lower fixing roller 55 and the heat of the fixing belt 54. The sheet P with the toner image having been fixed thereon is ejected by the sheet ejection roller 60.

The heating roller 52 is configured, for example, in such a way that the coated layer (e.g., fluorine resin) is laminated on the surface of the pipe made of cylindrical steel or aluminum for protection against abrasion with the fixing belt 54. The heating roller 52 incorporates a heater 52*a* as a heat source to heat the fixing belt 54, that is, to thermally fix the toner image on the sheet P. The heating roller 52 is heated by the radiant heat from this heater 52*a*, and the heat of the heating roller 52 is transferred to the fixing belt 54. The heating roller 52 is driven to rotate by the power supplied from a drive device (e.g., a motor, not illustrated), and the fixing belt 54 is driven by the rotation of this heating roller 52. The heating roller 52 drives the fixing belt 54 to rotate in conformity to the passing speed of the sheet P.

The upper fixing roller 53 is configured in such a way that an elastic layer of silicone rubber or sponge is laminated on the surface of the cylindrical steel or aluminum. In the present Example, the upper fixing roller 53 is not directly heated by the heater 52*a*.

The fixing belt 54 is an endless belt made up of a heat resistant layer, elastic layer, coated layer and others laminated on top of one another, and is characterized by flexibility. In the present Example, the heating roller 52 is directly heated by the heater 52*a*. The heat of the heating roller 52 is transferred to the fixing belt 54, whereby the fixing belt 54 is heated to the fixing temperature.

The lower fixing roller 55 is configured in such a way that the elastic layer of silicone rubber and mold releasing layer of fluorine resin or the like are laminated on the surface of the pipe made of cylindrical steel or aluminum. Similarly to the case of the heating roller 52, the lower fixing roller 55 incorporates a heater (not illustrated) and is capable of assisting in the supply of heat for thermal fixing.

To minimize the deformation of the upper fixing roller 53, fixing belt 54 and lower fixing roller 55, the fixing section 51 designed in this configuration is capable of releasing the state of pressure contact between the fixing belt 54 and lower fixing roller 55, whenever required. In the present Example, by being driven by a drive device (e.g., electric motor, not illustrated), the lower fixing roller 55 is configured to be capable of moving away from the fixing belt 54 (e.g., downward). This arrangement permits switching to be made between the state of pressure contact and the detached state with respect to the fixing belt 54.

Switching between the state of pressure contact and the detached state of the fixing belt 54 and lower fixing roller 55 can be performed by a method other than the movement of the lower fixing roller 55. For example, three pieces of the heating roller 52, upper fixing roller 53 and fixing belt 54 can be integrated as a set and these members can be moved away from the lower fixing roller 55 (e.g., upward). Further, the upper fixing roller 53 can be made to move in the circumferential direction around the heating roller 52.

The blowing section 56 is made up of a blower fan 57, duct 58 and heat insulating member 59. The blower fan 57 and duct 58 are connected with each other through the heat insulating member 59.

The blowing section 56 is located downstream of the fixing section 51 in the conveyance path FP for the sheet P to ensure that the tip end of the duct 58 (blowing outlet 58*c* to be described later) will face the sheet P ejection side of the fixing nip portion NP. In this blowing section 56, the air blown from the blower fan 57 is discharged from the blowing outlet 58*c* after having passed inside the duct 58, and the sheet P is separated from the fixing belt 54 by the wind pressure of the air (separation air) blown from the blowing outlet 58*c* (air separation). In the present Example, three such blowing sections 56 are arranged across the sheet width (in the direction perpendicular to the sheet conveying direction).

The blower fan 57 is a blowing device for blowing air by means of a rotating fan. It is a multi-blade fan provided with rotatable multiple forward curved blades. This blower fan 57 draws in external air into the main body through the air inlet (not illustrated) on the side of the main body, and blows this drawn air through the air blowing port 57*b*. In the blower fan 57 of the present Example, blowing of the separation air can be started or suspended, and the wind speed for separation air (air volume) can be adjusted through the rotational speed control.

The blower fan 57 is provided on the external wall surface of the housing (the upper wall surface 50*a* in the present Example) of the fixing device 50 that accommodates the fixing section 51 and a part of blowing section 56 (duct 58). To put it more specifically, the blower fan 57 is mounted on each of the three openings provided on the upper wall surface 50*a* of the housing, while incorporating the heat insulating members 59 on the air blowing port 57*b*. The layout of the blower fan 57 is determined by various design considerations and requirements, as exemplified by the requirements of installing the blower fan 57 outside the housing since air is drawn in by the blower fan 57, minimizing the distance from the blower fan 57 to the fixing belt 54 (separation air traveling distance), or placing the duct 58 close to the heating roller 52 (heat source 52*a*). However, that the shape and structure of the blower fan 57 are not restricted thereto. A fan of any shape and structure can be adopted as long as the fan is capable of blowing air. The blower fan 57 can blow air inside the apparatus instead of air outside the apparatus. Further, the blower fan 57 can blow gas other than air. Instead of the blower fan 57, an air blowing unit such as a compressor can also be employed.

The duct 58 is a duct made of aluminum or other metal having a cross section of rectangular shape, and is installed close to the heating roller 52 (heat source 52*a*). From the functional viewpoint, the duct 58 includes an inlet port 58*a* through which air is drawn in, an air guide section 58*b* for guiding air, and a blowing outlet 58*c* from which air is blown. The air entering the inlet port 58*a* is guided by the air guide section 58*b*, and is discharged from the blowing outlet 58*c*.

The inlet port 58*a* is configured in a shape corresponding to the air blowing port 57*b* of the blower fan 57, and is mounted on the openings provided on the upper wall surface 50*a* of the housing. The blowing outlet 58*c* is located at the position that is shifted toward the fixing belt 54 from the front (on the conveyance path FP for sheet P) on the sheet ejection side of the fixing nip portion NP and the place so that the separation air is allowed to flow toward the fixing belt 54 from the tangential direction of the belt. This layout of the blowing outlet 58*c* is based on the understanding that, out of the fixing belt 54 and lower fixing roller 55 in contact with the sheet Pat the fixing nip portion NP, the fixing belt 54 which is in contact with the surface of the sheet P to be fixed has a greater tendency to wind around the sheet P. Further, the blowing outlet 58*c* is formed in the shape of a slender opening whose longitudinal direction corresponds to the width-wise direction of the sheet P. The shape of a slender opening allows the blowing outlet 58*c* to diffuse separation air across the sheet width, and the nonuniformity in the air volume across the sheet width can be minimized.

In the duct 58, the duct wall surface forming the air guide section 58*b*, specifically, the outer surface of the duct wall surface (hereinafter referred to as "opposed wall surface" 58*d*) opposed to the heating roller 52 is coated in black. This opposed wall surface 58*d* faces the heating roller 52, and therefore, serves as a heat receiving surface for receiving the radiant heat from the heating roller 52 (radiant heat generated by the heater 52*a*). Thus, the efficiency of absorbing radiant heat from the heating roller 52 is improved by coating the outer surface of this opposed wall surface 58*d* in black When the duct 58 receives radiant heat by the heat receiving surface (opposed wall surface 58*d*), thermal exchange is performed between the opposed wall surface 58*d* and the air flowing inside the air guide section 58*b* (separation air). This arrangement ensures that the separation air is heated.

The heat insulating member 59 is a frame-shaped member having therein penetration regions corresponding to the air blowing port 57*b* of the blower fan 57 and the inlet port 58*a* of the duct 58, and is formed of a member for minimizing heat conduction, to put it another way, a heat insulating member (e.g., urethane foam). This heat insulating member 59 is located between the duct 58 and blower fan 57, and connection therebetween is provided to allow mutual communication. As described above, the opposed wall surface 58*d* of the duct 58 serves as a heat receiving surface, and therefore, the duct 58 itself is heated. Thus, the heat insulating member 59 is provided between the duct 58 and blower fan 57. This arrangement minimizes the heat of this duct 58 to be transferred to the blower fan 57. The heat insulating member 59 need not be an independent member. It is also possible to make such arrangements that the air blowing port 57*b* of the blower fan 57 is provided with a heat insulating property or the air inlet 58*a* of the duct 58 is provided with a heat insulating property in such a way that the functions of the heat insulating member 59 can be implemented.

FIG. 3 is a block diagram schematically representing the control system of the image forming apparatus 1 in the present Example. The control system of the image forming apparatus 1 includes such major components as the image forming control section 2 and fixing control section 3. The image forming control section 2 and fixing control section 3 are designed to communicate with each other.

A micro-computer formed of such major components as the CPU, ROM, RAM and I/O interface, for example, can be used as the image forming control section 2. The image forming control section 2 performs various forms of computation according to the control program stored in the ROM. Based on the result of this computation, the operation of the image forming apparatus 1 is controlled.

This image forming control section 2 obtains printing conditions as exemplified by the type of printing (single side printing or duplex printing), the type of the sheet (e.g., size, paper type such as plain-paper or thick paper and basis weight), image density and magnification and others, from the information set through the operation section (not illustrated) provided on the upper portion of the main body of the image forming apparatus 1 or the information received together with the output image data from a personal computer or another image forming apparatus. For example, a touch panel capable of handling the input operation according to the information shown on the display can be used as the operation section.

The image forming control section 2 controls each portion (image forming unit including the major components such as exposure sections 20Y through 20K, image forming sections 30Y through 30K, intermediate transfer section 40 and sheet feed section 90) of the image forming apparatus 1, whereby a series of the following processes are implemented. Thus, a toner image is transferred onto the sheet P being conveyed:

(1) Photoconductors 21Y through 21K are charged.

(2) An electrostatic latent image is formed on the photoconductors 21Y through 21K by means of exposure sections 15Y through 15K.

(3) Toner is attached to the electrostatic latent image having been formed.

(4) The toner image on the photoconductors 21Y through 21K is transferred onto the intermediate transfer belt 23 for the primary transfer.

(5) The sheet P is conveyed.

(6) The toner image on the intermediate transfer belt 23 is transferred to the sheet P for the secondary transfer.

A micro-computer formed of such major components as the CPU, ROM, RAM and I/O interface, for example, can be used as the fixing control section 3. The fixing control section 3 performs various forms of computation in conformity to the control program stored in the ROM. Based on the result of this computation, the operation of the fixing device 50 is controlled. From the functional viewpoint, the fixing control section 3 includes the main control section 3*a* and blow control section 3*b*.

Referencing the signal supplied from the image forming control section 2, the main control section 3*a* controls various sections of the fixing device 50, whereby fixing of the toner image onto the surface to be subjected to fixing of the sheet P is controlled. To put it more specifically, the main control section 3*a* controls the fixing temperature in the thermal fixing operation by controlling the heater 52*a*. Further, based on the signal from the image forming control section 2, the main control section 3*a* controls the rotation timing and rotation speed of the heating roller 52 and lower fixing roller 55. Further, based on the signal coming from the image forming control section 2, the main control section 3*a* outputs signals to the blow control section 3*b*.

The main control section 3*a* controls the lower fixing roller 55, thereby setting the lower fixing roller 55 to the detached state or to the state of pressure contact with respect to the fixing belt 54. In the present Example, the main control section 3*a* provides control in such a way that the lower fixing roller 55 will be kept in the state of pressure contact with the fixing belt 54 on a continuous basis during the operation time from the start of the operation to the end of the operation of the fixing device 50.

Referencing the signal coming from the main control section 3*a*, the blow control section 3*b* controls the state of the blower fan 57, specifically controls the wind speed for separation air coming from the blower fan 57. Here the wind speed indicates the output of the separation air blown from the blower fan 57, and is used as a broader meaning including the air volume, wind pressure and others, in addition to wind speed. From the functional viewpoint, the blow control section 3*b* is provided with a wind speed setting section 3*ba* and a fan control section 3*bb*. These two sections are used to control the blower fan 57.

The wind speed setting section 3*ba* sets the wind speed for separation air to be blown from the blower fan 57. The wind speed setting section 3*ba* outputs the set wind speed as a wind speed command value to the fan control section 3*bb*, whereby the wind speed for separation air from the blower fan 57 is controlled.

To put it more specifically, the wind speed setting section 3*ba* is provided with the first and second control modes that can be switched. The blower fan 57 is controlled in conformity to any one of the first and second control modes during the operation from the start of the operation to the end of operation of the fixing device 50. Here the first control mode is a control mode for controlling the blower fan 57 at the wind speed for separation having one or more wind speeds (wind speeds "a" through "c") to be set to separate the sheet P from the fixing belt 54 (for operation of the blower fan 57 at the wind speed for separation). The second control mode is a control mode (low-speed operation of the blower fan 57) for controlling the blower fan 57 at the wind speed (wind speed "d") which is smaller than the minimum setting wind speed (wind speed "c") out of the wind speeds for separation (wind speeds "a" through "c").

FIGS. 4*a* and 4*b* are explanatory diagrams showing the relationships between the wind speed for separation air and type of sheet P (paper type). FIG. 4*a* shows the wind speed for separation air in conformity to the paper types A through D when the control technique of the present Example is used. FIG. 4*b* shows the wind speed for separation air in conformity to the paper types A through D according to the conventional method without using the control technique of the present Example. In FIG. 4*b*, paper types A through C are distinguished from paper type D, wherein the paper types A through C require air separation for sheet P to be subjected to fixing, whereas the paper type D does not require air separation. For example, thick paper does not require air separation, while plain-paper or thin paper requires air separation. Further, for the paper types A through C requiring air separation, a different wind speed out of wind speeds "a" through "c" is set as a wind speed for separation according to the type (e.g., size, paper type and basis weight of sheet P). For example, a wind speed set for thin paper is higher than that for plain paper. Here the wind speeds "a" through "c" decrease in order of wind speed "a", wind speed "b" and wind speed "c" (a>b>c).

In contrast to such a conventional method, in the wind speed setting section 3*ba* of the present Example, the second control mode is selected on a priority basis during the operation of the fixing device 50 for controlling the blower fan 57. To be more specific, in the second control mode, the wind speed "d", which is smaller than the minimum setting wind speed "c" out of the wind speeds for separation, is set as the wind speed command value by the wind speed setting section 3*ba*, whereby the blower fan 57 performs a low-speed operation at the wind speed "d".

In the meantime, when printing has been initiated in conformance to the job (printing instruction), the wind speed setting section 3*ba* determines whether or not the mode must be switched to the first control mode, namely, whether or not the sheet P belongs to the paper types A through C that require air separation, based on the type of the sheet P to be subjected to fixing. If the mode needs to be switched to the first control mode (when the sheet P belongs to the paper type A through C requiring air separation), the wind speed setting section 3*ba* changes the mode from the second control mode over to the first control mode, whereby the blower fan 57 is controlled. If the first control mode has been selected, the wind speed setting section 3*ba* controls the blower fan 57 at the wind speed for separation. To put it more specifically, the wind speed setting section 3*ba* sets the wind speeds "a" through "c"

corresponding to paper types A through C for the sheet P to be subjected to fixing, as the wind speed command value. Thus, the blower fan 57 performs the separation wind speed operation at the wind speeds "a" through "c" having been set.

In the meantime, if selection of the first control mode is not needed (in the case of paper type D for which air separation is not necessary), the wind speed setting section 3*ba* maintains the second control mode without switching over to the first control mode, and controls the blower fan 57. To be more specific, in the second control mode, the wind speed setting section 3*ba* sets the wind speed "d" as the wind speed command value. Accordingly the blower fan 57 starts the low-speed operation at the wind speed "d".

The fan control section 3*bb* controls the blower fan 57 to ensure that the speed of the air fed from the blower fan 57 will meet the wind speed command value coming from the wind speed setting section 3*ba*. Further, the fan control section 3*bb* is capable of controlling the on-off operation of the power source of the blower fan 57.

Figure 5:
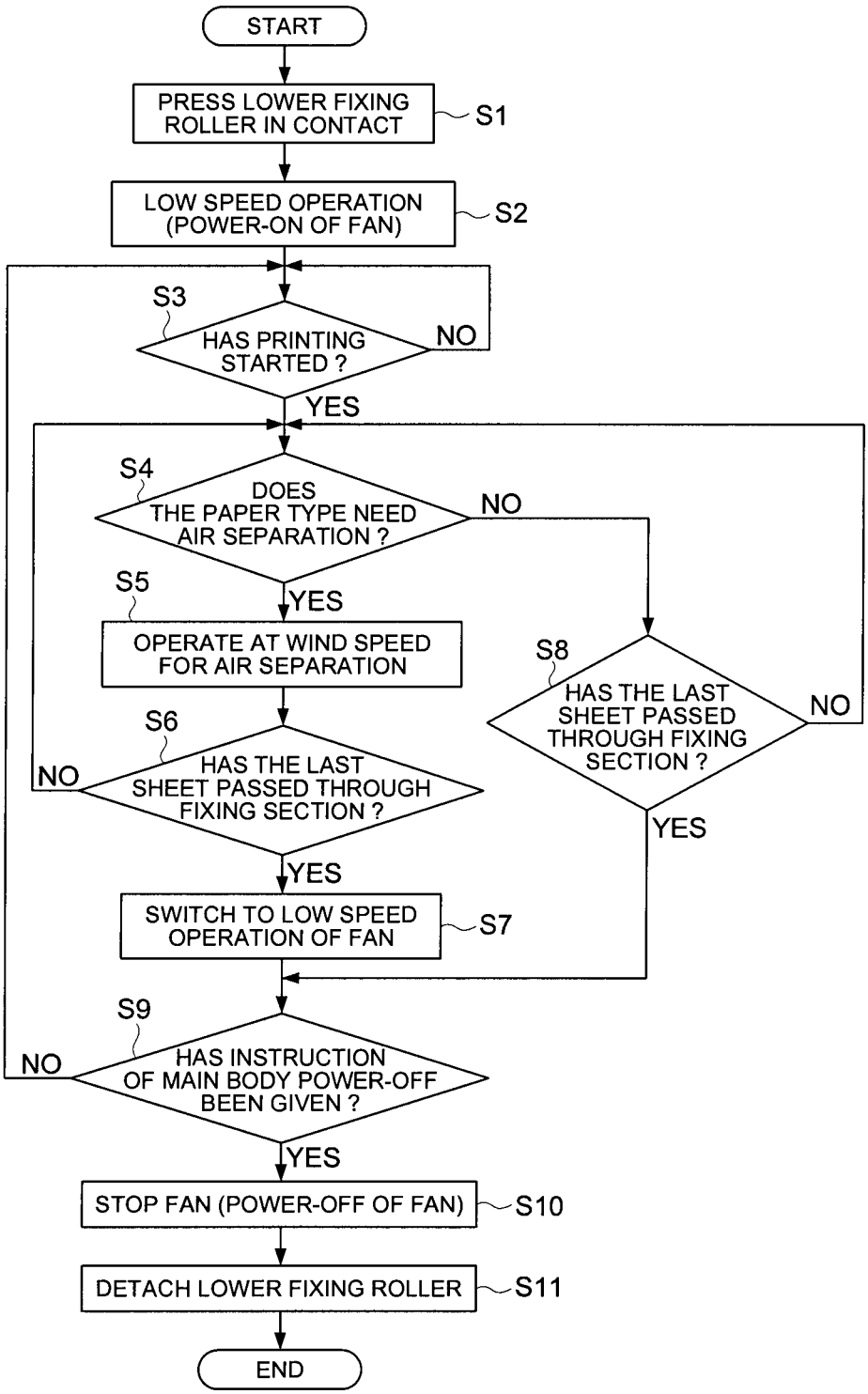
FIG. 5 is a flow chart showing the control procedure mainly for the wind speed control of the blower fan 57 of the fixing device 50 in a first Example.

FIG. 5 is a flow chart showing the control procedure mainly for the wind speed control of the blower fan 57 of the fixing device 50 in the present Example. By being triggered by the operation of turning on the power source of the image forming apparatus 1, processing of this flow chart is executed by the fixing control section 3. When the power source of the fixing device 50 has been turned on the lower fixing roller 55 is set to the state where it is detached from the fixing belt 54, and the power source of the blower fan 57 has been turned off.

In Step 1 (S1), the main control section 3*a* allows the lower fixing roller 55 to be pressed in contact with the fixing belt 54. In Step 2 (S2) following Step 1, the wind speed setting section 3*ba* selects the second control mode, and sets the air blowing command value to the wind speed "d". This wind speed command value is then outputted to the fan control section 3*bb*. The fan control section 3*bb* turns on the power source of the blower fan 57, and allows the low-speed operation of the blower fan 57 to be started in conformance to the wind speed command value (wind speed "d").

In Step 3 (S3), the main control section 3*a* receives the control signal from the image forming control section 2, and determines whether the printing starts or not, namely, whether or not printing has started in conformance to the job (printing instruction). Here, the image forming control section 2 has received the printing start command together with printing conditions through the operation of the operation section 4 or together with printing conditions and input image data from the personal computer and another image forming apparatus. When printing is to be started, the image forming control section 2 outputs the information to this effect, together with the printing conditions, to the fixing control section 3.

If the affirmative decision is made in Step 3, that is, if the printing has started, the operation goes to Step 4 (S4). If the negative decision is made in Step 3, that is, if the printing has not started, the processing of Step 3 is executed again. If the negative decision is made in Step 3 after startup of the image forming apparatus 1 or after termination of the job, the system goes to the so-called standby mode where the system ready to print on a sheet P waits for a printing instruction.

In Step 4, based on the printing conditions sent from the image forming control section 2, the wind speed setting section 3*ba* determines whether or not the sheet P to be subjected to fixing at present out of a series of sheets P to be subjected to fixing in one job belongs to the paper type that requires air separation. If the affirmative decision is made in Step 4, that is, if the sheet P belongs to the paper type that requires air separation, the operation proceeds to Step 5 (S5). If the negative decision has been made in Step 4, that is, if the sheet P belongs to the paper type that does not require air separation, the operation proceeds to Step 8 (S8) to be described later.

In Step 5, the wind speed setting section 3*ba* changes the control mode from the second control mode to the first control mode and sets the wind speed of the blower fan 57. To put it more specifically, the wind speed setting section 3*ba* has a map defining the relationship between the paper type and wind speed as shown in FIG. 4*a*, and selects the wind speed corresponding to the paper type of the sheet P to be subjected to fixing, out of the wind speeds "a" through "c" of the wind speed for separation. The wind speed setting section 3*ba* sets the selected wind speed as the wind speed command value, and outputs this wind speed command value to the fan control section 3*bb*. The fan control section 3*bb* operates the blower fan 57 at the wind speed for air separation based on the wind speed command value (any one of the wind speeds "a" through "c").

In Step 6 (S6), the wind speed setting section 3*ba* determines if the last sheet has passed through the fixing section 51 or not, that is, if the sheet P to be subjected to fixing last out of a series of sheets P to be subjected to fixing has passed through the fixing nip portion NP or not. If the decision is affirmative in Step 6 (S6), that is, if the last sheet has passed through the fixing section 51, the operation proceeds to Step 7 (S7). If the decision is negative in Step 6 (S6), that is, if the sheet having passed through the fixing section 51 is not the last one, the operation goes back to Step 4.

In Step 7, the wind speed setting section 3*ba* changes the control mode from the first control mode to the second control mode, and sets the wind speed command value to the wind speed "d". This wind speed command value is outputted to the fan control section 3*bb*. The fan control section 3*bb* allows the low-speed operation of the blower fan 57 to be started according to the wind speed command value (wind speed "d").

In Step 8, similarly to the case of Step 6, the wind speed setting section 3*ba* determines if the last sheet P has passed through the fixing section 51 or not. If the decision is affirmative in Step 8, that is, if the last sheet has passed through the fixing section 51, the operation proceeds to Step 9 (S9). If the decision is negative in Step 8, that is, if the sheet having passed through the fixing section 51 is not the last one, the operation returns to Step 4.

In Step 9, based on the signal sent from the image forming control section 2, the wind speed setting section 3*ba* determines if the power of the main body of the image forming apparatus has been turned off or not. If the decision in Step 9 is affirmative, that is, if the power source of the main body has been turned off, the operation proceeds to Step 10 (S10). If the decision in Step 9 is negative, that is, if the power source of the main body has not been turned off, the operation goes back to Step 3.

In Step 10, the wind speed setting section 3*ba* sends its intention of suspending the blower fan 57 and turning off the power source to the fan control section 3*bb* as a wind speed command value. The fan control section 3*bb* suspends the blower fan 57, and turns off the power source. In Step 11 (S11) following Step 10, the main control section 3*a* detaches the lower fixing roller 55 from the fixing belt 54.

As described above, in the present Example, the wind speed setting section 3*ba* has two switchable control modes, namely the first control mode (control mode for operating the blower fan 57 at the wind speed for separation) and the second control mode (control mode for operating the blower fan 57 at a low speed). The blower fan 57 is controlled by any one of the first control mode and the second control mode.

In the aforementioned structure, the wind speed setting section 3*ba* is provided with the second control mode. This ensures separation air to be blown from the blower fan 57 without the blower fan 57 being stopped, even in cases where operation is performed in an operation other than the operation at the wind speed for air separation. Among the parts constituting the blower fan 57, the bearing for rotatably supporting multiple forward curved blades and the electronic parts such as the capacitor installed in the drive circuit are vulnerable under the conditions of high temperature, and the blower fan 57 is subjected to deterioration under such conditions. When the separation air is suspended, air under the conditions of high temperature and high humidity in the fixing section 51 (e.g., in the vicinity of the fixing nip portion NP) will enter the blower fan 57, with the result that deterioration of the blower fan 57 may occur. Further, the temperature inside the blower fan 57 is lower than the temperature for fixing. Accordingly, if air under the conditions of high temperature and high humidity has entered the blower fan 57, condensation may occur inside the blower fan 57. This condensation may cause deterioration of the blower fan 57, or may be scattered toward the fixing belt 54 and lower fixing roller 55 when the blower fan 57 has just started to blow air. The present Example, however by being provided with the second control mode, minimizes the entry of air under the conditions of high temperature and high humidity into the blower fan 57. This reduces the possibility of the blower fan 57 deteriorating. This prolongs the service life of the blower fan 57, eventually the service life of the fixing device 50. Further, since splashing of the condensed water onto the fixing belt 54 and lower fixing roller 55 is minimized, the fixing quality is improved. Further, in the second control mode, a low-speed operation is performed, that is, the blower fan 57 is operated at the wind speed lower than that for separation in the first control mode. This provides the aforementioned advantages while power consumption is minimized.

In the present Example, the wind speed setting section 3*ba* selects the second control mode on a priority basis, and the blower fan 57 is controlled. Based on the type of the sheet P to be subjected to fixing, the wind speed setting section 3*ba* determines whether switching to the first control mode is required or not. If switching to the first control mode is required (for paper types A through C that require air separation), the wind speed setting section 3*ba* changes the second control mode to the first control mode and controls the blower fan 57.

In the aforementioned structure, in cases where air separation is required, the control mode can be changed from the second control mode to the first control mode. This effectively suppresses the fixing belt 54 being wound with the sheet P. Moreover, since the second control mode is selected in other cases, ambient air under the conditions of high temperature and high humidity is prevented from entering the blower fan 57.

In the present Example, the wind speed setting section 3*ba* controls the blowing section 57 according to any one of the first and second control modes during the operation period from the startup to the termination of the operation of the fixing device 50.

In the aforementioned structure, during the operation of the fixing device 50, control is provided in the second control mode except when the first control mode is selected. This prevents the ambient air under the conditions of high temperature and high humidity from entering the blower fan 57 during the operation of the fixing device 50.

Further, in the present Example, in response to the operation period from the startup to the termination of the operation of the fixing device 50, the main control section 3*a* provides control in such a way that the lower fixing roller 55 is pressed in contact with the fixing belt 54.

For example, according to one of the conventionally known techniques, in order to reduce deformation of the elastic layer in the upper fixing roller 53, fixing belt 54 and lower fixing roller 55, the lower fixing roller 55 is set to the detached state when fixing is not performed (e.g., during the period from the ejection of the last sheet to the start of the next printing operation). In the present Example, however, the blower fan 57 is controlled in the second control mode except when the first control mode is selected (during the fixing process execution period). As a result, the separation air fed from the blower fan 57 passes between the fixing belt 54 and lower fixing roller 55, and the separation air heated in this process may be fed to the upstream side of the fixing device 50 (on the upstream side along the sheet P conveyance path). In this case, the temperature of the image forming section 30Y through 30K is raised. This may cause toner to be fixed, with the result that the quality of the formed image may be deteriorated. According to the present Example, however, control is provided in such a way that the lower fixing roller 55 and fixing belt 54 are pressed in contact, in response to the operation period of the fixing device 50. This prevents the separation air from passing between the fixing belt 54 and lower fixing roller 55 and prevents the air from being fed upstream of the fixing device 50. This arrangement minimizes the deterioration in the quality of the formed image.

In the aforementioned Example, when it has been determined that the sheet P has passed through the fixing section 51, the mode of the blower fan 57 is switched from the control of wind speed for air separation to the low-speed operation. However, the present Example is not restricted thereto. For example, when the sheet P has been ejected to the ejection tray 75, the mode of the blower fan 57 can be switched to the low-speed operation. Upon termination of a series of printing operations, the control of the wind speed for air separation can be switched over to the low-speed operation. (This applies to the Example to be described later).

SECOND EXAMPLE

The following describes the image forming apparatus 1 of the second Example in the present invention. The difference between the image forming apparatus 1 of the second Example and that of the first Example is found in the wind speed control method for the blower fan 57 in the fixing device 50. For the same structure as those of the aforementioned first Example, by citing the same drawing numbers and numerals of reference, it will not be described to avoid duplication. The difference from the first Example will be mainly described.

In the present Example, to minimize the deformation of the elastic layer constituting the fixing belt 54 and lower fixing roller 55, the main control section 3*a* is capable of switching the state of pressure contact between the fixing belt 54 and lower fixing roller 55 to the detached state thereof; whenever required, during the operation of the fixing device 50. To put it more specifically, the main control section 3*a* determines if the lower fixing roller 55 in the state of pressure contact should be switched to in the detached state or not, when the mode is shifted to the low power mode where the power consumption is suppressed.

In response to the aforementioned structure, when the main control section 3*a* changes the lower fixing roller 55 from the state of pressure contact to the detached state, the wind speed setting section 3*ba* suspends the blowing of air by the blower fan 57 to discontinue the second control mode (low-speed operation control mode for blower fan 57). To put it more specifically, when discontinuing the second control mode, the wind speed setting section 3*ba* suspends the blowing of air by the blower fan 57, before the main control section 3*a* switches the lower fixing roller 55 from the state of pressure contact over to the detached state.

In the meantime, when the main control section 3*a* switches the lower fixing roller 55 from the detached state to the state of pressure contact, the wind speed setting section 3*ba* allows the blower fan 57 to start air blowing so that the second control mode is resumed. To put it more specifically, when resuming the second control mode having been suspended, the wind speed setting section 3*ba* allows the blower fan 57 to start air blowing after the main control section 3*a* has switched the lower fixing roller 55 from the detached state over to the state of pressure contact.

When suspending the blowing of air by the blower fan 57, the wind speed setting section 3*ba* suspends the supply of power to the blower fan 57. To put it another way, the wind speed setting section 3*ba* sends the wind speed command value for instructing to turn off the power to the fan control section 3*bb*.

Figure 6:
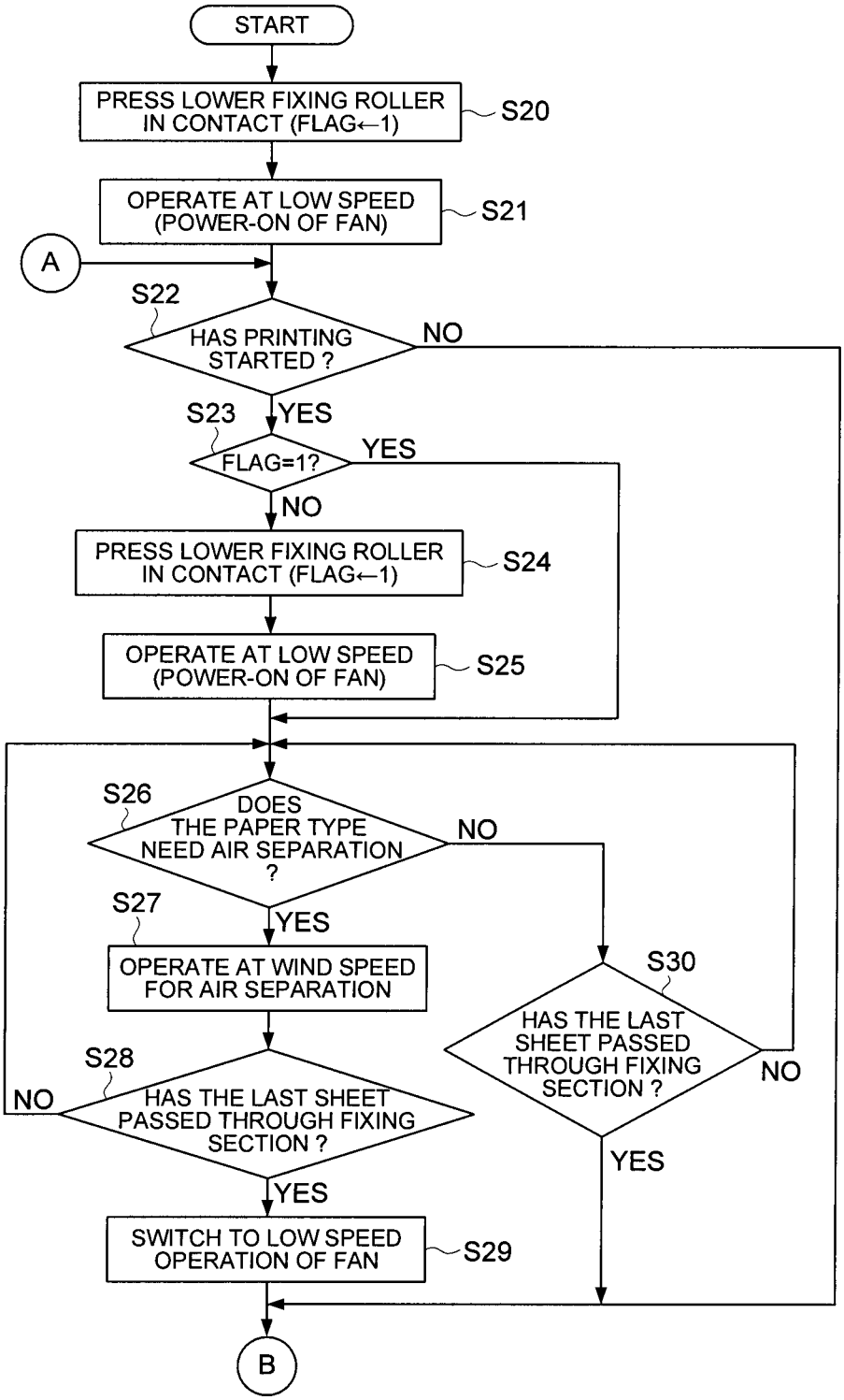
FIG. 6 is a flow chart showing the control procedure mainly for the wind speed control of the blower fan 57 of the fixing device 50 in a second Example.
Figure 7:
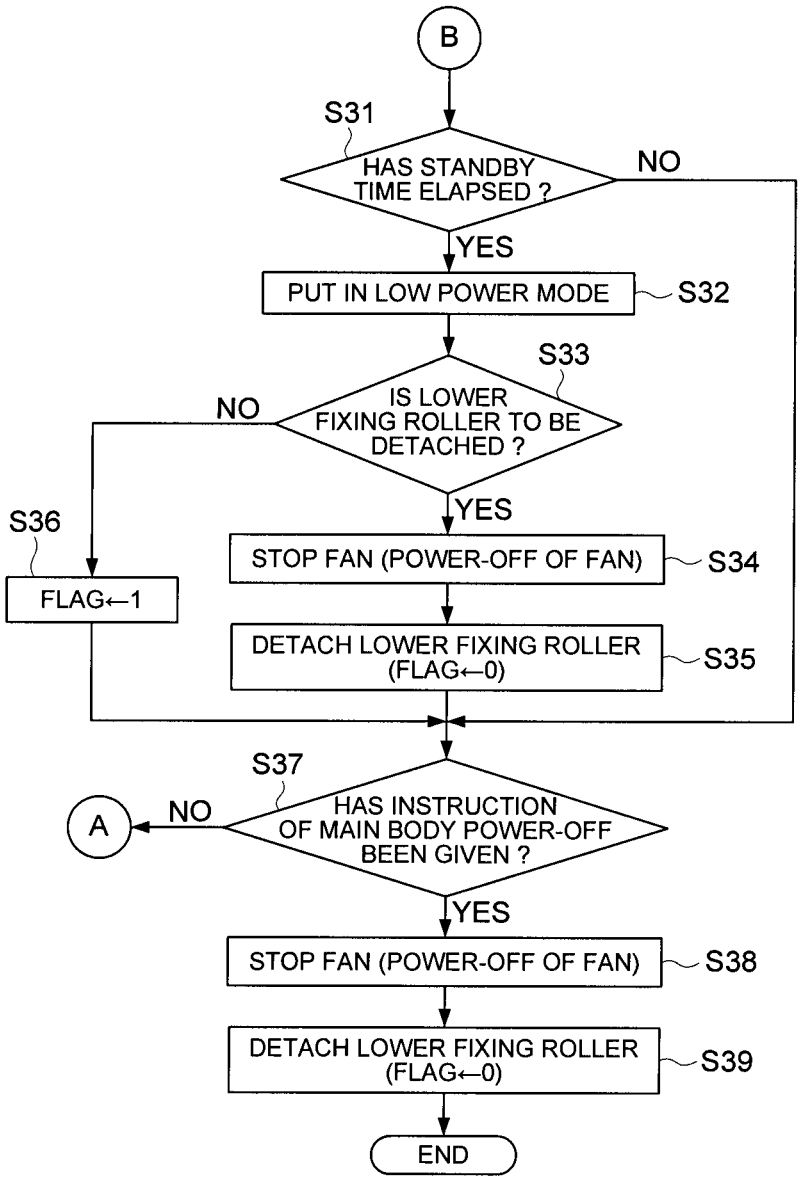
FIG. 7 is a flow chart showing the control procedure mainly for the wind speed control of the blower fan 57 of the fixing device 50 in a second Example.

FIGS. 6 and 7 are flow charts showing the control procedure mainly for the wind speed control of the blower fan 57 of the fixing device 50 in the present Example. By being triggered by the operation of turning on the power source of the image forming apparatus 1, processing of this flow chart is executed by the fixing control section 3. When the power source of the fixing device 50 has been turned on, the lower fixing roller 55 is set to the state where it is detached from the fixing belt 54, and the power source of the blower fan 57 has been turned off.

In Step 20 (S20), the main control section 3*a* allows the lower fixing roller 55 to be pressed in contact with the fixing belt 54. Here the main control section 3*a* sets the control flag to "1". This control flag is set to "1" when the lower fixing roller 55 and fixing belt 54 are placed in the state of pressure contact, and is set to "0" when the lower fixing roller 55 and fixing belt 54 are placed in the detached state.

In Step 21 (S21), the wind speed setting section 3*ba* selects the second control mode, and sets the wind speed command value to the wind speed "d". This wind speed command value is then outputted to the fan control section 3*bb*. The fan control section 3*bb* turns on the power source of the blower fan 57, and allows the low-speed operation of the blower fan 57 to be started in conformance to the wind speed command value (wind speed "d").

In Step 22 (S22), the wind speed setting section 3*ba* receives the control signal from the image forming control section 2, and determines whether or not the printing has started. If the mode has been shifted to the low power mode to be described later, the low power mode is suspended and a warm-up operation is recovered so that the printing operation is enabled. After that, the printing operation is started according to the job.

If the decision is affirmative in Step 22, that is, if the printing has started, the operation goes to Step 23 (S23). If the negative decision is made in Step 22, that is, if the printing has started, the operation goes to Step 31 (S31) to be described later. If the negative decision is made in Step 22 after starting the image forming apparatus 1 or after termination of the job, the operation goes to the so-called standby mode where the system ready to print on a sheet P waits for a printing instruction (except for the low power mode to be described later).

In Step 23, the wind speed setting section 3*ba* determines if the control flag is set to "1" or not If the decision in Step 23 is affirmative, that is, if the control flag is set to "1", the operation goes to Step 26 (S26), skipping Step 24 (S24) and Step 25 (S25). In the meantime, if the decision in Step 23 is negative, that is, if the control flag is set to "0", the operation goes to Step 24.

In Step 24, the main control section 3*a* presses the lower fixing roller 55 in contact with the fixing belt 54. Further, the main control section 3*a* sets the control flag to "1".

In Step 25, to resume the second control mode having been suspended, the wind speed setting section 3*ba* sets the air blowing command value to the wind speed "d", and sends this wind speed command value to the fan control section 3*bb*. The fan control section 3*bb* turns on the power of the blower fan 57, and allows the blower fan 57 to operate in the low-speed operation mode in conformance to the wind speed command value (wind speed "d").

In Step 26 (S26) through Step 29 (S29), similarly to the case of Steps 4 through 8 of the first Example, the decision is made to see if the sheet belongs to the paper type that requires air separation or not. The control mode is set to the first control mode or the second control mode is kept without change, depending on the result of this decision.

In Step 31 (S31), referencing the elapsed time indicated on a counter (not illustrated), the wind speed setting section 3*ba* determines if the elapsed time has exceeded the standby time. If no job has been inputted after the power of the main body is turned on, this counter indicates the time elapsed after the power is turned on. If a job has been inputted, the counter indicates the time elapsed after termination of the fixing operation of the closest job (after the last sheet has passed through the fixing section 51). In the meantime, the standby time is the time set for shifting to the low power mode to be described later. A predetermined time is set as the standby time.

If the decision in Step 31 is affirmative, that is, if the elapsed time on the counter has exceeded the standby time, the operation goes to Step 32 (S32). If the decision in Step 31 is negative, that is, if the elapsed time on the counter has not exceeded the standby time, the operation goes to Step 37 to be described later.

In Step 32, the main control section 3*a* goes to the low power mode. This low power mode is used to set the temperature of the heater 52*a* built in the heating roller 52 at a value lower than the value for normal operations, or to shut down power supply to a sensor (not illustrated) and others.

In Step 33 (S33), the main control section 3*a* determines if the lower fixing roller 55 should be detached from the fixing belt 54 or not. For example, in order to minimize the deformation of the lower fixing roller 55, upper fixing roller 53 and fixing belt 54, the main control section 3*a* determines if the lower fixing roller 55 should be detached from the fixing belt 54 or not, based on the elapsed time indicated on the counter. If the decision in Step 33 is affirmative, that is, if the lower fixing roller 55 is to be detached, the operation goes to Step 34 (S34). If the decision in Step 33 is negative, that is, if the lower fixing roller 55 is not to be detached, the operation goes to Step 36 (S36) and the control flag is set to "1".

In Step 34, to suspend the second control mode, the wind speed setting section 3*ba* sends the wind speed command value for suspending the blower fan 57 and turning off the power, to the fan control section 3*bb*. The fan control section 3*bb* suspends the blower fan 57, and turns off the power. In Step 35 (S35) following Step 34, the main control section 3*a* detaches the lower fixing roller 55 from the fixing belt 54 and sets the control flag to "0".

In Step 37 (S37), the wind speed setting section 3*ba* receives the control signal from the image forming control section 2 and determines if the power of the main body of the image forming apparatus 1 has been turned off or not. If the decision in Step 37 is affirmative, that is, if the power of the main body of the image forming apparatus 1 has been turned off, the operation goes to Step 38 (S38). If the decision in Step 37 is negative, that is, if the power of the main body of the image forming apparatus 1 has not been turned off, the operation goes back to the aforementioned Step 22.

In Step 38, the wind speed setting section 3*ba* sends the wind speed command value for suspending the blower fan 57 and turning off power, to the fan control section 3*bb*. The fan control section 3*bb* suspends the blower fan 57 and turns off the power. In Step 39 (S39) following Step 38, the main control section 3*a* detaches the lower fixing roller 55 from the fixing belt 54.

As described above, in the present Example, the main control section 3*a* changes the state of the lower fixing roller 55 from the state of pressure contact to the detached state whenever required. This minimizes the deformation of the elastic layer constituting the fixing belt 54 and lower fixing roller 55, and suppresses the reduction in the fixing performance. Further, the deterioration of the fixing device 50 can be minimized.

Further, in the present Example, when shifting to the low power mode for reducing the power consumption, the main control section 3*a* determines whether or not the lower fixing roller 55 in the state of pressure contact should be switched over to in the detached state. When the lower fixing roller 55 and fixing belt 54 are kept suspended for a long time, for example, when the system has been shifted to the low power mode, the fixing belt 54 and lower fixing roller 55 tend to deform. In the present Example, however, such a problem can be solved.

In the aforementioned Example, when the system shifts to the low power mode, a decision is made to see if the state of the lower fixing roller 55 should be switched from the state of pressure contact to the detached state or not. However, in the present Example, without being restricted to such a technique, for example, when the system shifts to the standby mode, a decision can be made to see if the state of the lower fixing roller 55 should be changed from the state of pressure contact to the detached state, as in the processing shown in Step 33 through Step 35. This structure effectively minimizes the deformation of the fixing belt 54 and lower fixing roller 55.

Further, in the present Example, when the main control section 3*a* changes the fixing belt 54 from the state of pressure contact to the detached state, the wind speed setting section 3*ba* suspends blowing of air by the blower fan 57, and discontinues the second control mode. Especially when discontinuing the second control mode, the wind speed setting section 3*ba* suspends the blowing of air by the blower fan 57 before the main control section 3*a* changes the state of the lower fixing roller 55 from the state of pressure contact to the detached state.

The aforementioned structure solves the problem wherein the heated air may be fed upstream of the fixing device 50, because the blower fan 57 is suspended when the fixing belt 54 is detached from the lower fixing roller 55.

Further, in the present Example, when suspending the blowing of air by the blower fan 57, the wind speed setting section 3*ba* turns off the power supply to the blower fan 57. When the blower fan 57 is suspended, air under the conditions of high temperature and high humidity tends to enter the blower fan 57 easily. If the humidity is higher, so-called ion-migration occurs to the soldered portion of the drive circuit, with the result that the blower fan 57 may be damaged. In the present Example, however, the supply of power to the blower fan 57 is cut off, and therefore, such a problem can be minimized.

Further, in the present Example, when the main control section 3*a* changes the state of the lower fixing roller 55 from the detached state to the state of pressure contact, the wind speed setting section 3*ba* allows the blower fan 57 to start air blowing, and permits the second control mode to be resumed. Especially when the suspended second control mode is to be resumed, the wind speed setting section 3*ba* allows the blower fan 57 to start air blowing after the main control section 3*a* has changed the state of the lower fixing roller 55 from the detached state to the state of pressure contact.

According to the aforementioned structure, when the fixing belt 54 and lower fixing roller 55 have been pressed in contact with each other, the second control mode is resumed. This structure solves the problem that the heated air may be fed upstream of the fixing device 50.

In the present Example, when the system shifts to the low power mode, a decision is made to see if the lower fixing roller 55 should be detached or not. However, a decision can be made to see if the lower fixing roller 55 should be detached or not, after the termination of fixing.

In the aforementioned Example, after the lower fixing roller 55 has been pressed in contact with the fixing belt 54, the low-speed operation is changed to the control of the wind speed for air separation, that is, to the wind speed which is higher than that in the low-speed operation. However, the present Example is not restricted thereto. It is only required that the control of the wind speed for air separation should be selected before the sheet P reaches the fixing nip portion NP.

In the aforementioned Examples, three wind speeds are exemplified as the wind speed for separation. However, the Examples are not restricted thereto. It is sufficient if the wind speed for separation has at least one wind speed. It is also possible to set wind speeds subdivided according to the paper type such as the size, class and basis weight.

The image forming apparatus in the embodiments of the present invention has been described. However, the present invention is not restricted to these embodiments. The present invention can be embodied in a number of variations without departing from the scope of the invention claimed. Further, the fixing device itself which constitutes the image forming apparatus functions as a part of the present invention. Further, in the aforementioned embodiments, the image forming control section 2 and fixing control section 3 are described as independent items. However, it is also possible to make such arrangements that the function to be performed by one of the control sections is performed by the other control section, whereby the structure of a single control section can be configured. (To put it another way, the relevant hardware need not be separated into two pieces).

According to the embodiment of the present invention, the control section is provided with a second control mode. This structure ensures separation air to be blown from the blowing section at a low power without the blow section being stopped, even in cases where the blowing section is controlled in a mode other than the first control mode. Thus, the air under the conditions of high temperature and high humidity is prevented from entering the blowing section, with the result that factors causing deterioration of the blowing section are minimized, and the service life of the blowing section, eventually the fixing device is prolonged. This structure further prevents the condensed water from being splashed toward the fixing member, and improves the fixing quality.

What is claimed is:

1. A fixing device comprising:

a fixing section which has a pair of fixing members for fixing a toner image on a sheet by passing the sheet through a fixing nip portion and supplying heat to the toner image having been transferred onto the sheet, the fixing nip portion being formed by pressing the pair of fixing members in contact with each other;

a blowing section for separating the sheet from the pair affixing members by blowing gas to the sheet from a sheet ejection side of the fixing nip portion; and a control section for controlling a wind speed of the gas blown by the blowing section, the control section having, as switchable modes, a first control mode for controlling the blowing section at a wind speed for separation which includes one or more set wind speeds having been set for separating the sheet from the pair of fixing members, a second control mode for controlling the blowing section at a wind speed smaller than a smallest set wind speed of the wind speed for separation, and allowing the blowing section to stop blowing, wherein the control section selects the second control mode on a priority basis over the first control mode, wherein the control section determines whether or not the control mode needs to be switched to the first control mode according to a type of the sheet to be subjected to fixing, wherein the pair of fixing members are controlled by the control section so as to permit switching between a state of pressure contact in which the pair of fixing members are pressed in contact with each other, and a detached state in which the pair of fixing members are detached from each other, and wherein the control section controls the blowing section in any one of the first and second control modes so as not to stop blowing gas while the pair of fixing members is in the state of pressure contact.

2. The fixing device of claim 1, wherein when switching a state of the pair of fixing members from the state of pressure contact to the detached state, the control section allows the blowing section to stop gas blowing and suspends the second control mode.

3. The fixing device of claim 2, wherein when shifting to a standby mode in which a printing instruction is being waited for or a low power mode in which a power consumption is reduced, the control section determines whether or not the state of the pair of fixing members should be switched from the state of pressure contact to the detached state.

4. The fixing device of claim 2, wherein when returning the state of the pair of fixing members having been set to the detached state to the state of pressure contact, the control section allows the blowing section to start gas blowing, and starts the second control mode again.

5. The fixing device of claim 4, wherein when restarting the second control mode having been suspended, the control section allows the blowing section to start gas blowing after switching the state of the pair of fixing members from the detached state to the state of pressure contact.

6. The fixing device of claim 2, wherein when allowing the blowing section to stop gas blowing, the control section suspends supply of power to the blowing section.

7. The fixing device of claim 1, wherein the control section controls the blowing section in any one of the first control mode and the second control mode so as not to stop blowing gas from when printing of a job starts until when a last sheet of the job passes through the fixing section.

8. An image forming apparatus comprising:

an image forming unit for transferring a toner image onto a sheet; and a fixing unit for applying a fixing process to the sheet with the toner image transferred thereon, the fixing unit comprising:

a fixing section which has a pair of fixing members for fixing the toner image on the sheet by passing the sheet through a fixing nip portion and supplying heat to the toner image having been transferred onto the sheet, the fixing nip portion being formed by pressing the pair of fixing members in contact with each other;

a blowing section for separating the sheet from the pair of fixing members by blowing gas to the sheet from a sheet ejection side of the fixing nip portion; and a control section for controlling a wind speed of the gas blown by the blowing section, the control section having, as switchable modes, a first control mode for controlling the blowing section at a wind speed for separation which includes one or more set wind speeds having been set for separating the sheet from the pair of fixing members, a second control mode for controlling the blowing section at a wind speed smaller than a smallest set wind speed of the wind speed for separation, and allowing the blowing section to stop blowing, wherein the control section selects the second control mode on a priority basis over the first control mode, wherein the control section determines whether or not the control mode needs to be switched to the first control mode according to a type of the sheet to be subjected to fixing, wherein the pair of fixing members are controlled by the control section so as to permit switching between a state of pressure contact in which the pair of fixing members are pressed in contact with each other, and a detached state in which the pair of fixing members are detached from each other, and wherein the control section controls the blowing section in any one of the first and second control modes so as not to stop blowing gas while the pair of fixing members is in the state of pressure contact.

9. The image forming apparatus of claim 8, wherein the control section controls the blowing section in any one of the first control mode and the second control mode so as not to stop blowing gas from when printing of a job starts until when a last sheet of the job passes through the fixing section.

* * * * *